US008631750B2

(12) United States Patent
Hasegawa et al.

(10) Patent No.: US 8,631,750 B2
(45) Date of Patent: Jan. 21, 2014

(54) SEWING MACHINE

(71) Applicants: Katsuhisa Hasegawa, Kasugai (JP); Shin Ota, Inazawa (JP); Kenichi Mizuno, Nagoya (JP)

(72) Inventors: Katsuhisa Hasegawa, Kasugai (JP); Shin Ota, Inazawa (JP); Kenichi Mizuno, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/790,699

(22) Filed: Mar. 8, 2013

(65) Prior Publication Data

US 2013/0255556 A1 Oct. 3, 2013

(30) Foreign Application Priority Data

Mar. 28, 2012 (JP) ..... 2012-072909

(51) Int. Cl.
*D05B 55/14* (2006.01)
*D05B 69/02* (2006.01)

(52) U.S. Cl.
USPC ..... 112/221

(58) Field of Classification Search
USPC ..... 112/98, 220, 221, 274, 284, 443, 462, 112/450
See application file for complete search history.

(56) References Cited

U.S. PATENT DOCUMENTS

| | | | | | |
|---|---|---|---|---|---|
| 2,667,133 | A | * | 1/1954 | Court | 112/443 |
| 2,989,016 | A | * | 6/1961 | Johnson | 112/462 |
| 3,713,407 | A | * | 1/1973 | Ciecior | 112/221 |
| 3,782,311 | A | * | 1/1974 | Adams et al. | 112/450 |
| 4,177,745 | A | * | 12/1979 | Adams et al. | 112/221 |
| 4,312,284 | A | * | 1/1982 | Adams et al. | 112/451 |
| 4,569,299 | A | * | 2/1986 | Vogel | 112/315 |

FOREIGN PATENT DOCUMENTS

| | | |
|---|---|---|
| JP | Y2-58-051900 | 11/1983 |
| JP | Y2-03-033323 | 7/1991 |
| JP | Y2-03-050867 | 10/1991 |
| JP | U-06-021588 | 3/1994 |

OTHER PUBLICATIONS

U.S. Appl. No. 13/790,618, filed Mar. 8, 2013 in the name of Hasegawa et al.

* cited by examiner

*Primary Examiner* — Ismael Izaguirre
(74) *Attorney, Agent, or Firm* — Oliff & Berridge, PLC

(57) ABSTRACT

A sewing machine includes a needle bar, a needle bar base, a base frame, a guide member, and a fixing member. A sewing needle is attachable to a lower end portion of the needle bar. The needle bar base is configured to support the needle bar to allow the needle bar to be moved in an up-down direction. A first engagement portion is provided to a lower end portion of the needle bar base. The base frame is configured to swingably support an upper end portion of the needle bar base. A second engagement portion is provided to a lower end portion the base frame. A guide member includes a third engagement portion configured to engage with the first engagement portion and guide movement of the first engagement portion in a predetermined direction and a fourth engagement portion configured to engage with the second engagement portion.

6 Claims, 10 Drawing Sheets

SEWING MACHINE

CROSS-REFERENCE TO RELATED APPLICATION

This application claims priority to Japanese Patent Application No. 2012-072909 filed Mar. 28, 2012, the content of which is hereby incorporated herein by reference.

BACKGROUND

The present disclosure relates to a sewing machine that allows a clearance between a sewing needle and a hook point of a shuttle to be adjusted.

A known sewing machine mainly includes a bed, a pillar, an arm, and a head. The arm is provided with a drive shaft. The drive shaft may be driven by a sewing machine motor. The head is provided with a needle bar base. The needle bar base supports a needle bar. Due to the rotation of the drive shaft, the needle bar may be moved in the up-down direction. The bed is provided with a shuttle. The shuttle may be rotated in accordance with the rotation of a lower shaft, which may be rotated in conjunction with the drive shaft. An upper thread may be supplied to a sewing needle that is attached to the needle bar. A lower thread may be supplied from a bobbin that is housed in the shuttle. The upper thread and the lower thread may be interlaced by the needle bar and the shuttle working in cooperation with each other, thus forming a stitch on a work cloth.

A sewing machine is provided with a function to sew zigzag stitching. The zigzag stitching is sewing that is performed while the needle bar is swung left and right. An upper end portion of the needle bar base is swingably supported. The zigzag stitching is performed by moving a lower end portion of the needle bar base in the left-right direction.

In order to reliably form a stitch with a sewing machine, it is important to adjust a clearance between a sewing needle and a hook point of the shuttle. The clearance between the sewing needle and the hook point of the shuttle is hereinafter referred to as the needle gap. The needle gap may be adjusted for a left needle gap and a right needle gap. The left needle gap is a clearance between the sewing needle and the hook point when the sewing needle is in a left needle drop position (a left reference line position). The left reference line position is a leftmost needle drop position in the greatest zigzag width. The right needle gap is a clearance between the sewing needle and the hook point when the sewing needle is in a right needle drop position (a right reference line position). The right reference line position is a rightmost needle drop position in the greatest zigzag width. For example, in a known sewing machine, a plate is fixed to an arm by two screws. By displacing an attachment position of the plate in relation to the arm, it is possible to adjust the left and right needle drop positions. By adjusting the left and right needle drop positions, it is possible to adjust the needle gaps.

SUMMARY

In the above-described known sewing machine, a procedure when adjusting the needle gaps is as follows. First, the two screws fixing the plate to the arm may be loosened, such that the plate can be freely moved. The attachment position of the plate may be changed. The plate may be once more fixed to the arm by the screws. Thus, for example, in a case where the right needle gap is adjusted after the left needle gap has been adjusted, it is necessary to adjust the right needle gap while maintaining the adjusted left needle gap unchanged. As a result, an operation to adjust the needle gaps may be difficult.

Embodiments of the broad principles derived herein provide a sewing machine in which, after one of a left and a right needle gaps has been adjusted, the adjusted one of the needle gaps remains unchanged.

Embodiments provide a sewing machine that includes a needle bar, a needle bar base, a base frame, a guide member, and a fixing member. A sewing needle is attachable to a lower end portion of the needle bar. A needle bar base is configured to support the needle bar to allow the needle bar to be moved in an up-down direction. A first engagement portion is provided to a lower end portion of the needle bar base. A base frame is configured to swingably support an upper end portion of the needle bar base. A second engagement portion is provided to a lower end portion the base frame. A guide member includes a third engagement portion and a fourth engagement portion. The third engagement portion is configured to engage with the first engagement portion and guide movement of the first engagement portion in a predetermined direction. The fourth engagement portion is configured to engage with the second engagement portion. A fixing member is configured to fix the guide member to the base frame. When the needle bar base is in a reference position, a first reference line of the first engagement portion, a second reference line of the second engagement portion, and a third reference line of the fourth engagement portion are in a same straight line, and the guide member is configured to be swingable about the same straight line in a state in which fixing of the fixing member with respect to the base frame is loosened.

BRIEF DESCRIPTION OF THE DRAWINGS

Embodiments will be described below in detail with reference to the accompanying drawings in which.

DETAILED DESCRIPTION

Hereinafter, a sewing machine 1 according to an embodiment will be explained with reference to the drawings.

Figure 1:
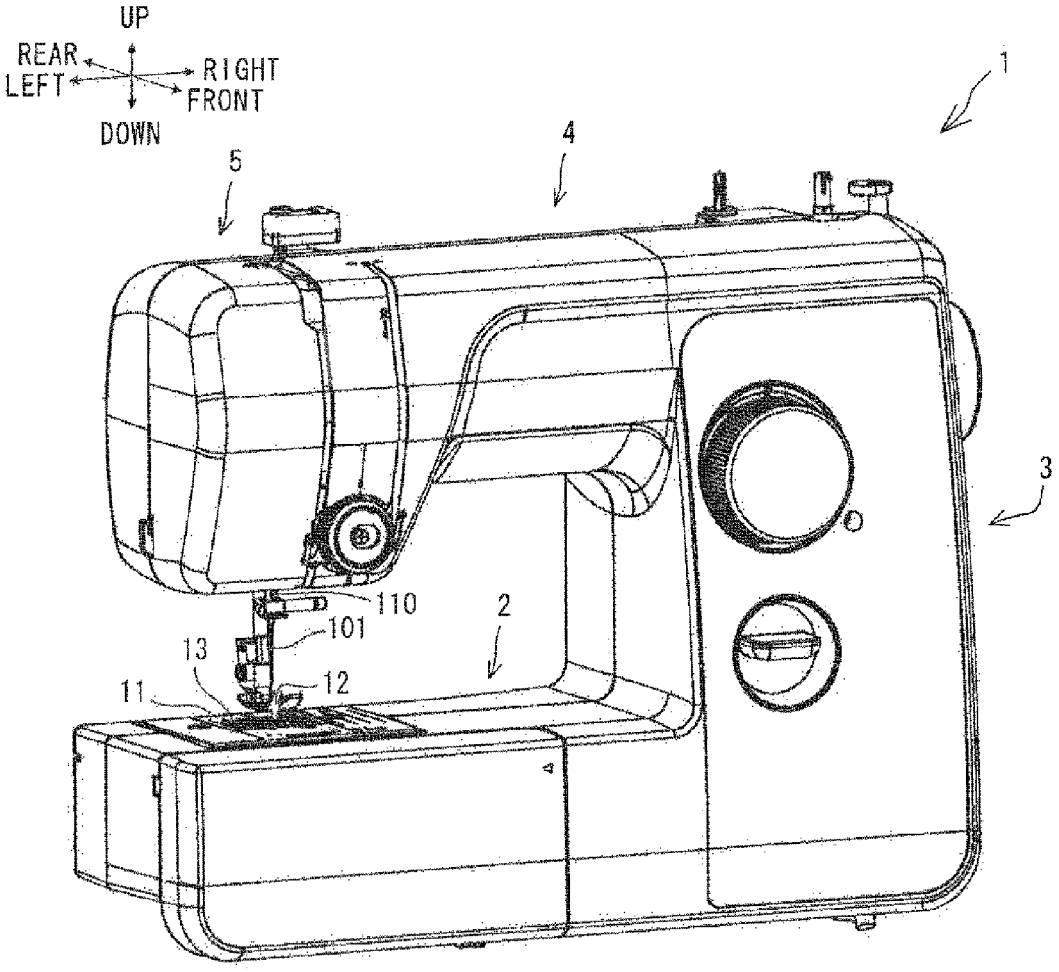
FIG. 1 is a perspective view of a sewing machine.

A configuration of the sewing machine 1 will be explained with reference to FIGS. 1 and 2. In the following explanation, the lower right side, the upper left side, the lower left side, the upper right side, the upper side, and the lower side of FIG. 1 are respectively the front side, the rear side, the left side, the right side, the upper side, and the lower side of the sewing machine 1. More specifically, a direction in which a pillar 3, which is described below, extends is the up-down direction of the sewing machine 1. A longitudinal direction of a bed 2 and an arm 4 is the left-right direction of the sewing machine 1. An explanation of the structural members of the sewing machine 1 shown in FIGS. 3 to 10 is made with reference to the front-rear direction and the left-right direction when the structural members are attached to the sewing machine 1.

As shown in FIG. 1, the sewing machine 1 is provided with the bed 2, the pillar 3, the arm 4, and a head 5. The bed 2 extends in the left-right direction. A horizontal shuttle 8 (refer to FIG. 2) and the like are provided in the interior of the left portion of the bed 2. The pillar 3 extends upward from the right end of the bed 2. A sewing machine motor (not shown in the drawings) and the like are provided in the interior of the pillar 3. The arm 4 extends to the left from the upper side of the pillar 3 such that the arm 4 faces the upper surface of the bed 2. A drive shaft 51 (refer to FIG. 2) and the like are provided in the interior of the arm 4. The head 5 is provided on the left side of the arm 4. A needle bar module 10 (refer to FIG. 2) and the like are provided in the interior of the head 5. The needle bar module 10 includes a needle bar support mechanism 100, which will be described below. The needle bar support mechanism 100 includes a needle bar 110 that can be moved in the up-down direction. The needle bar 110 is exposed from the lower side of the head 5, and extends downward. A sewing needle 101 may be attached to the lower end of the needle bar 110.

Figure 2:
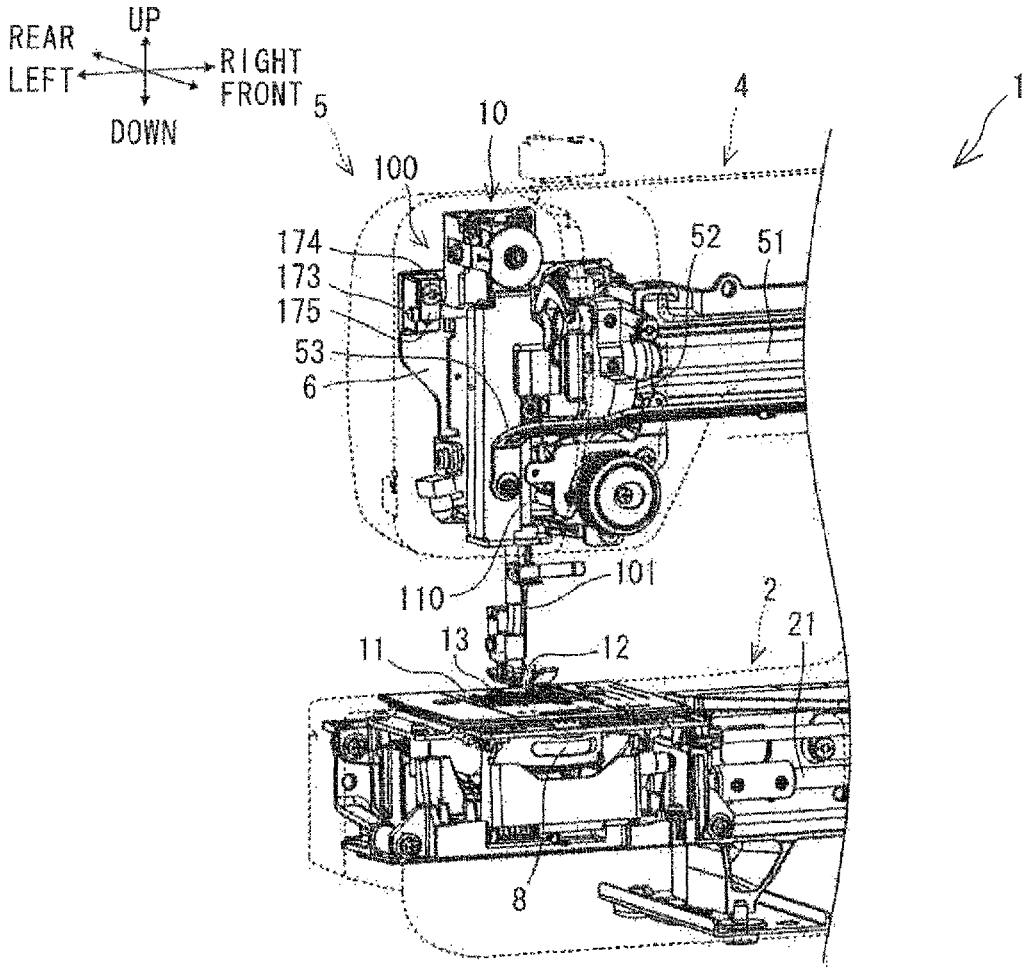
FIG. 2 is a perspective view showing an internal configuration of a left end portion of the sewing machine including a head.

As shown in FIG. 2, a needle plate 11 is provided on the upper portion of the bed 2. The needle plate 11 has a needle hole 12 that is positioned directly below the needle bar 110. The sewing needle 101 that is attached to the needle bar 110 can be inserted through the needle hole 12. The horizontal shuttle 8 is provided below the needle plate 11. The horizontal shuttle 8 may house a bobbin (not shown in the drawings) on which a lower thread (not shown in the drawings) is wound. A lower shaft 21 may be rotated in conjunction with the drive shaft 51. The horizontal shuttle 8 may be rotated in the horizontal direction in accordance with the rotation of the lower shaft 21. The horizontal shuttle 8 includes a hook point 9 (refer to FIG. 9). The leading end portion of the hook point 9 faces a peripheral direction of the horizontal shuttle 8. The hook point 9 may seize a loop of an upper thread. When the needle bar 110 is lowered by a needle bar drive mechanism 16, the sewing needle 101 attached to the needle bar 110 may approach the hook point 9 of the horizontal shuttle 8. A feed dog 13 is provided under the needle plate 11. The feed dog 13 may move a work cloth by a predetermined feed distance.

Figure 3:
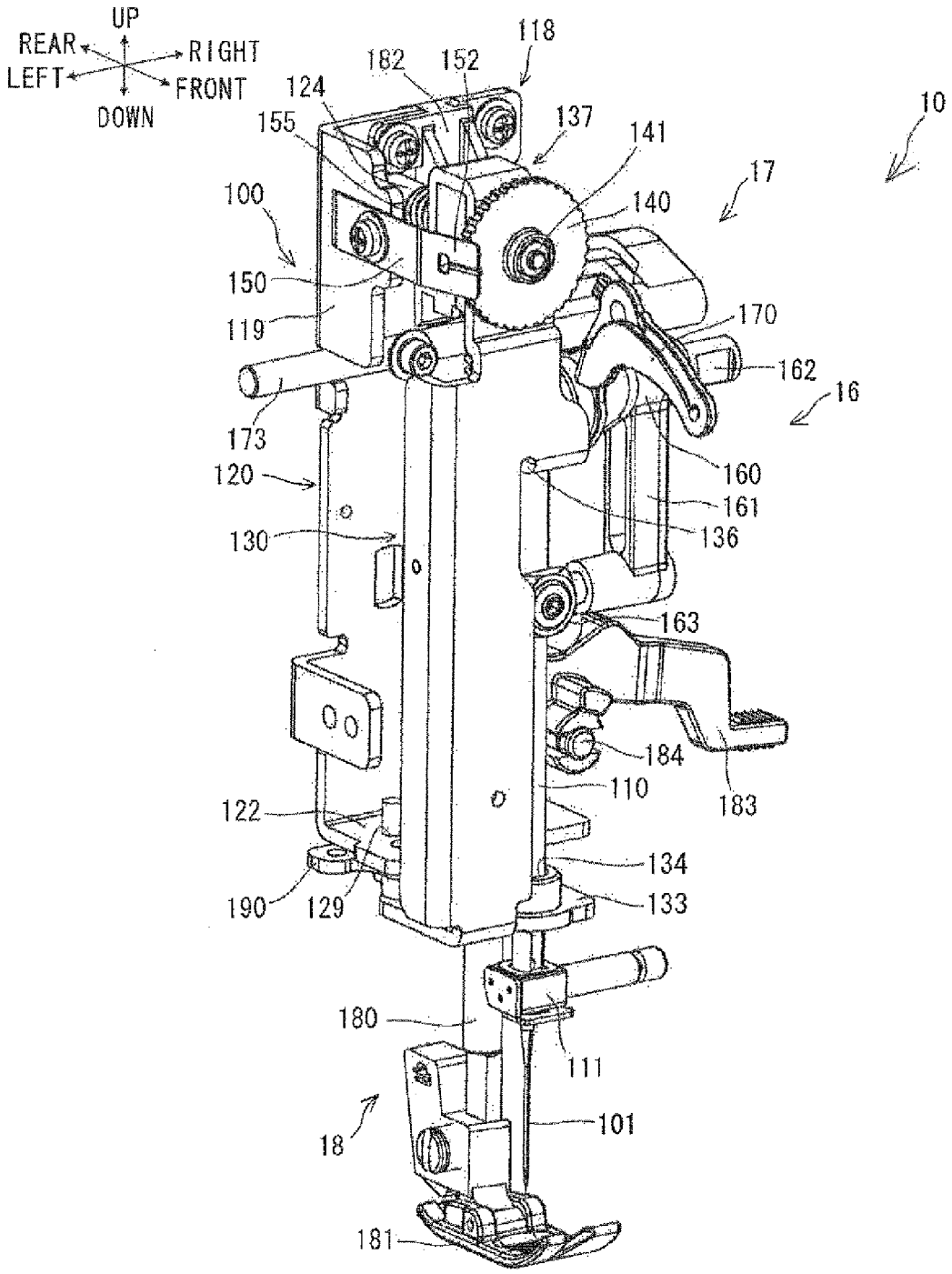
FIG. 3 is a perspective view of a needle bar module.

A configuration of the needle bar module 10, which is provided on the head 5, will be explained with reference to FIGS. 2 to 8. The needle bar module 10 shown in FIGS. 2 and 3 is a module that is formed by integrating the needle bar support mechanism 100, the needle bar drive mechanism 16, a thread take-up drive mechanism 17, and a presser foot lifting mechanism 18. The needle bar support mechanism 100 supports the needle bar 110. The sewing needle 101 may be attached to the needle bar 110. The needle bar drive mechanism 16 may drive the needle bar 110 to reciprocate in the up-down direction. The thread take-up drive mechanism 17 may drive a thread take-up lever 170 (refer to FIG. 3). The presser foot lifting mechanism 18 may raise and lower a presser bar 180 (refer to FIG. 3). The needle bar module 10 is fixed to a machine frame 6 inside the head 5. The rotation of the drive shaft 51 may be transmitted to the needle bar drive mechanism 16 and the thread take-up drive mechanism 17, so that the needle bar drive mechanism 16 and the thread take-up drive mechanism 17 may be driven.

Figure 4:
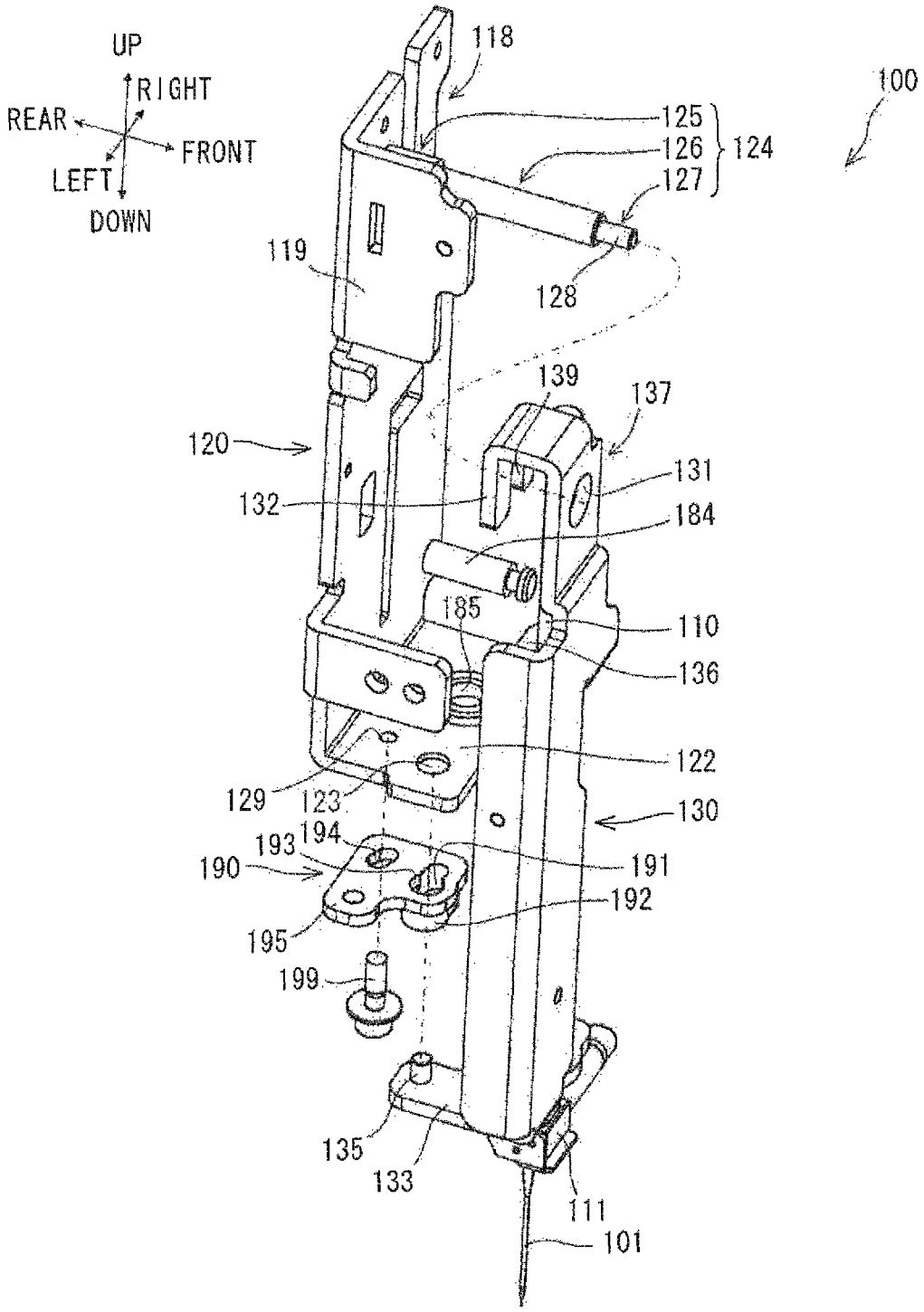
FIG. 4 is an exploded perspective view of a needle bar support mechanism.
Figure 5:
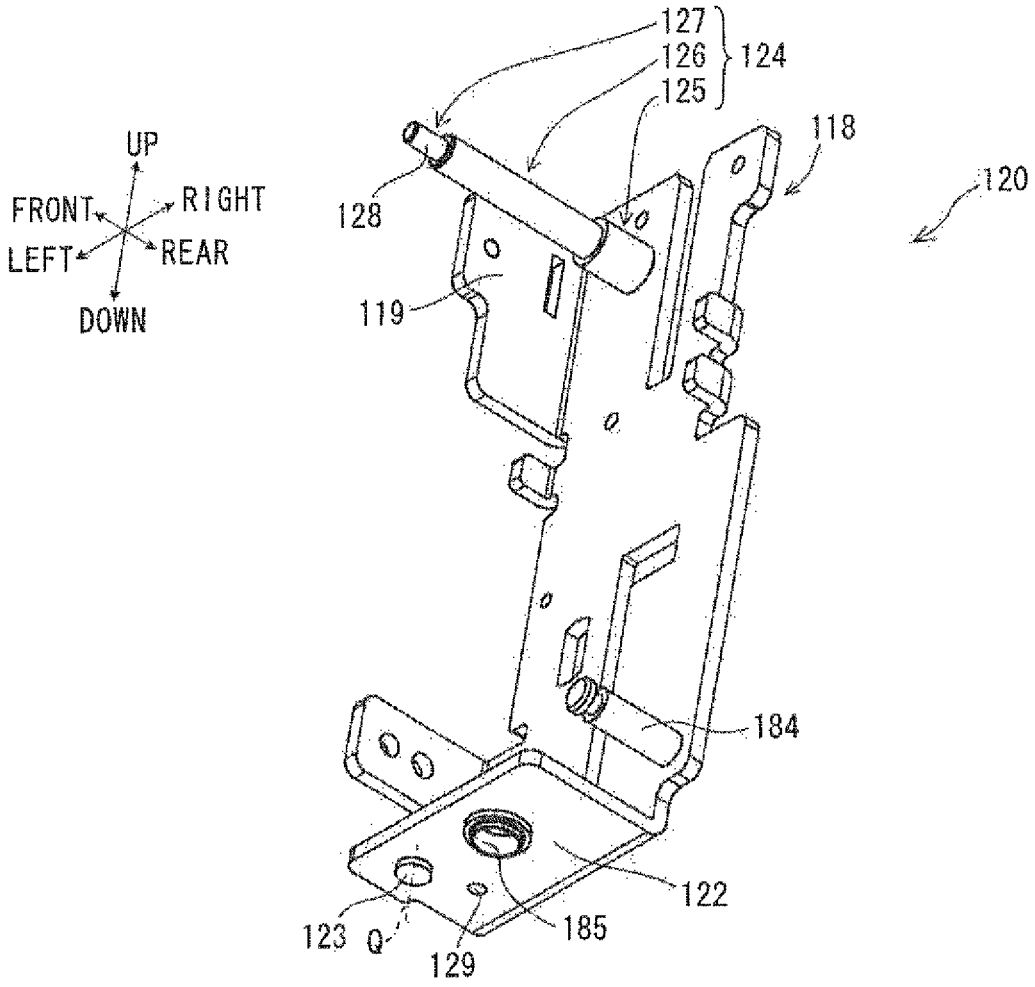
FIG. 5 is a perspective view of a base holder.

As shown in FIG. 3 to FIG. 5, a base holder 120 of the needle bar support mechanism 100 is formed of a metal plate that extends in the up-down direction. A support shaft 173, which extends in the left-right direction, is fixed to the base holder 120, slightly above the center of the base holder 120 in the up-down direction. The length of the support shaft 173 is longer than the length, in the left-right direction, of the base holder 120. The support shaft 173 protrudes from the base holder 120 in the left and right directions. The left end portion of the support shaft 173 is fixed to the machine frame 6 by a presser plate 175 and a screw 174 (refer to FIG. 2). Although not shown in the drawings, the right end portion of the support shaft 173 is also fixed to the machine frame 6 in the same manner. Although not shown in the drawings, the lower end portion of the base holder 120 is fixed to the machine frame 6 such that an inclination (as seen from the side) of the base holder 120 can be adjusted. In a case where the screw 174 that fixes the support shaft 173 is slightly loosened, the base holder 120 may be swung with the support shaft 173 as the center of rotation, in the side view. Thus, the base holder 120 may be fixed to the machine frame 6 after the inclination of the base holder 120, namely the posture of the base holder 120 in relation to the machine frame 6, has been adjusted.

A support portion 122 is provided on the lower end portion of the base holder 120. The support portion 122 is a portion that extends toward the front from the lower edge of the base holder 120. A support hole 185 is formed in a position close to the right side of the support portion 122. The support hole 185 penetrates the support portion 122 in the up-down direction. A boss portion 123 is provided in a position close to the front left side of the support portion 122. The boss portion 123 is a portion that protrudes downward from the support portion 122 in a cylindrical shape. A central line of the boss portion 123 is denoted by Q. A screw hole 129 is formed in a position close to the rear left side of the support portion 122. The screw hole 129 penetrates the support portion 122 in the up-down direction.

As shown in FIG. 3, the presser bar 180 that extends in the up-down direction is inserted through the support hole 185 (refer to FIG. 4). A presser foot 181 is provided on the lower end portion of the presser bar 180. A support piece 182 is attached to the upper portion of the base holder 120. The upper end portion of the presser bar 180 is supported by the support piece 182. In this manner, the presser bar 180 is supported on the base holder 120 such that the presser bar 180 can be moved in the up-down direction. A presser spring (not shown in the drawings) is provided around the presser bar 180. The presser bar 180 is biased downward by the biasing force of the presser spring. A lever shaft 184 is provided on the lower right portion of the base holder 120. The lever shaft 184 protrudes toward the front. A presser lever 183 is supported such that the presser lever 183 may be pivoted in relation to the lever shaft 184. When the presser lever 183 is operated, the presser bar 180 and the presser foot 181 are raised and lowered. The presser foot lifting mechanism 18 includes the presser bar 180, the presser spring, and the presser lever 183, which are described above.

The thread take-up lever 170 and the thread take-up drive mechanism 17 are disposed at the right of the base holder 120. The thread take-up lever 170 and the thread take-up drive mechanism 17 are known mechanisms and are briefly explained here. A thread take-up crank 52 is fixed to the left end portion of the drive shaft 51. The thread take-up crank 52 may be rotated integrally with the drive shaft 51. The thread take-up crank 52 may be rotated in accordance with the rotation of the drive shaft 51, so that the thread take-up drive mechanism 17 may be driven. By the driving of the thread take-up drive mechanism 17, the thread take-up lever 170 may be moved in the up-down direction in synchronization with the reciprocating motion in the up-down direction of the needle bar 110.

As shown in FIGS. 4 and 5, a support shaft 124 is provided on an upper end portion 118 of the base holder 120. The support shaft 124 extends toward the front. The support shaft 124 pivotably supports a needle bar base 130 that will be described below. The support shaft 124 is provided with a base end portion 125, a trunk portion 126, and a leading end portion 127. The trunk portion 126 is formed having a smaller diameter than that of the base end portion 125. The trunk portion 126 extends longer in the front-rear direction. The leading end portion 127 is formed having a diameter that is smaller than a diameter of the trunk portion 126. A male screw 128 is formed on the leading end portion 127. The male screw 128 is a right-hand thread screw. Further, an attachment portion 119 is formed on the base holder 120. The attachment portion 119 is a portion that extends toward the front from the upper left portion of the base holder 120. A plate spring 150, which will be described below, is fixed to the attachment portion 119.

Figure 6:
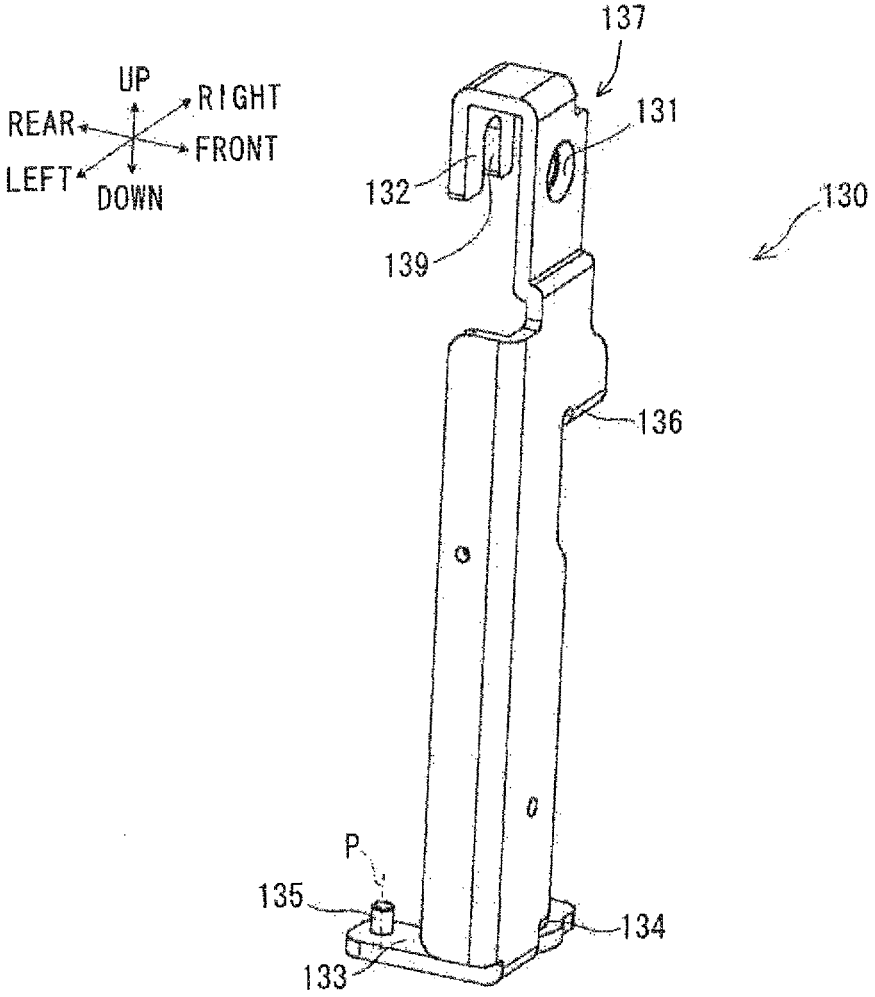
FIG. 6 is a perspective view of a needle bar base.

As shown in FIGS. 4 and 6, the needle bar base 130 is formed of a metal plate that extends in the up-down direction. A through hole 131 is formed in an upper end portion 137 of the needle bar base 130. The through hole 131 penetrates the upper end portion 137 in the front-rear direction. The inner diameter of the through hole 131 is slightly larger than the outer diameter of the trunk portion 126 of the support shaft 124. The through hole 131 is formed in a tapered shape by chamfering, such that the through hole 131 becomes narrower from the front toward the rear. Further, the needle bar base 130 includes a pressing portion 132. The pressing portion 132 is a portion that extends downward from the upper rear end portion of the needle bar base 130. A groove 139 is formed in the pressing portion 132. The groove 139 is generally an inverted U-shape. The width of the groove 139 in the left-right direction is slightly larger than the outer diameter of the trunk portion 126 of the support shaft 124. The trunk portion 126 fits into the groove 139.

The needle bar base 130 includes a support portion 133. The support portion 133 is a portion that extends toward the rear from the lower edge of the needle bar base 130. A hole 134 (refer to FIG. 3) is formed in a position toward the right side of the support portion 133. The hole 134 penetrates the support portion 133 in the up-down direction. A left portion of the support portion 133 protrudes further to the rear than a right portion of the support portion 133. A cylindrical pin 135 is provided on the rear end portion of the left portion of the support portion 133. The pin 135 protrudes upward from the support portion 133. A central line of the pin 135 is denoted by P. A direction in which the pin 135 extends is parallel to the needle bar 110. The outer diameter of the pin 135 is generally the same as the size of a groove width of a long groove 191 that is provided in the guide member 190, which will be described below.

The needle bar base 130 includes a bent portion 136. The bent portion 136 is a portion that extends to the rear from a portion of the needle bar base 130 above the center of the needle bar base 130 in the up-down direction such that the bent portion 136 is parallel to the support portion 133. A hole (not shown in the drawings) having a same inner diameter as a diameter of the hole 134 is formed in the bent portion 136. As shown in FIG. 3, the needle bar 110 is inserted into and supported by the hole 134 and the hole of the bent portion 136, such that the needle bar 110 may be moved in the up-down direction. An attachment portion 111 is provided on the lower end portion of the needle bar 110. The sewing needle 101 may be attached to and removed from the attachment portion 111.

As shown in FIG. 3, a compression coil spring 155 is mounted around the outer periphery of the trunk portion 126. The rear end of the compression coil spring 155 is in contact with a stepped portion between the trunk portion 126 and the base end portion 125. The support shaft 124 is inserted through the through hole 131 of the needle bar base 130 and the groove 139. In this manner, the needle bar base 130 is supported by the support shaft 124 in a state in which the needle bar base 130 can be rotated around the support shaft 124. The leading end of the compression coil spring 155 is in contact with the pressing portion 132 of the needle bar base 130.

A disc-shaped adjustment dial 140 is attached to the leading end portion 127 of the support shaft 124. Although not shown in detail in the drawings, a hole is provided in the center of the adjustment dial 140. The trunk portion 126 of the support shaft 124 may be inserted through the hole in the adjustment dial 140. A nut fixing portion (not shown in the drawings) is formed to the front of the adjustment dial 140. The nut fixing portion is a recessed portion that is formed in a position such that the center of the nut fixing portion is concentric with the center of the hole in the adjustment dial 140. A nut 141 is fitted into and fixed to the nut fixing portion. A hemispheric contact portion is formed around the periphery of the hole in the adjustment dial 140. A straight knurl is formed on an outer peripheral surface of the adjustment dial 140.

As shown in FIGS. 3 and 4, the support shaft 124 is inserted through the through hole 131 of the needle bar base 130. The leading end portion 127 of the support shaft 124 is inserted through the hole in the adjustment dial 140. The male screw 128 formed on the leading end portion 127 is screwed into a female screw of the nut 141. The contact portion of the adjustment dial 140 is in contact with the tapered surface of the through hole 131 of the needle bar base 130. At this time, the compression coil spring 155 is pressed in the rearward direction by the pressing portion 132 of the needle bar base 130, and is compressed in the axial direction of the support shaft 124. The compression coil spring 155 presses the pressing portion 132 of the needle bar base 130 toward the side of the leading end portion 127, from the side of the base end portion 125 of the support shaft 124. In other words, between the base holder 120 and the adjustment dial 140, the needle bar base 130 is maintained in a state of being biased toward the adjustment dial 140, due to the biasing force of the compression coil spring 155. As described above, the male screw 128 is a right-hand thread screw. Thus, when the adjustment dial 140 is rotated in the clockwise direction, the adjustment dial 140 and the needle bar base 130 are moved toward the rear. In contrast, when the adjustment dial 140 is rotated in the anti-clockwise direction, the adjustment dial 140 and the needle bar base 130 are moved toward the front. In this manner, by rotating the adjustment dial 140, the adjustment dial 140 may be moved in the axial direction of the support shaft 124. In accordance with the movement of the adjustment dial 140, the needle bar base 130 may be moved in the axial direction of the support shaft 124.

As shown in FIG. 3, the rectangular plate spring 150 is provided on the attachment portion 119 of the base holder 120. The rear end (the base end) of the plate spring 150 is fixed to the attachment portion 119 by a screw. A leading end portion 152 of the plate spring 150 is in contact with the outer peripheral surface (the straight knurl) of the adjustment dial 140, and biases the adjustment dial 140 in the rightward direction (in the radial direction). Specifically, the plate spring 150 regulates the rotation of the adjustment dial 140.

Figure 7:
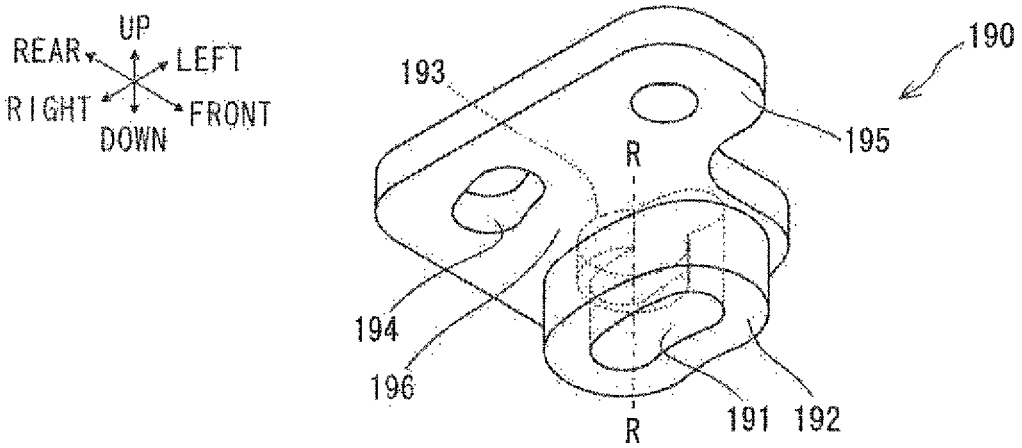
FIG. 7 is a perspective view of a lower side of a guide member, as seen from the front and right.
Figure 8:
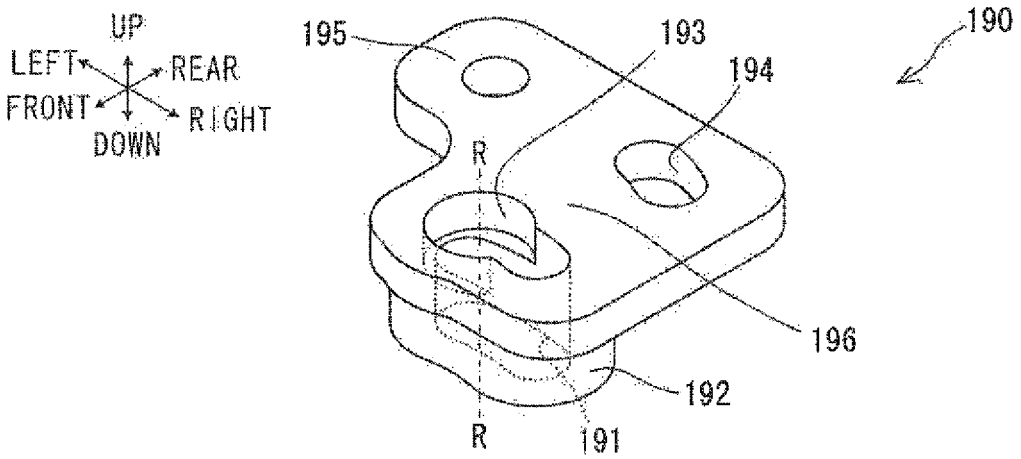
FIG. 8 is a perspective view of an upper side of the guide member, as seen from the front and right.

As shown in FIG. 4, the guide member 190 is provided on the lower surface of the support portion 122 of the base holder 120. The guide member 190 is formed of a synthetic resin material. As shown in FIGS. 7 and 8, the guide member 190 includes a flat plate portion 196, which is generally L-shaped in a plan view, and a long groove portion 192. A generally elliptical engaging hole 194 is formed in the flat plate portion 196. A fixing screw 199 (refer to FIG. 4) is inserted through the engaging hole 194. The fixing screw 199 is screwed into a screw hole 129 of the support portion 122. By fastening the fixing screw 199 in the screw hole 129, the guide member 190 is fixed to the base holder 120.

The guide member 190 includes a protruding portion 195. The protruding portion 195 is a portion of the flat plate portion 196 that protrudes toward the left. A user may grasp the protruding portion 195 with the user's fingers.

The long groove portion 192 of the guide member 190 protrudes downward from the flat plate portion 196. The long groove 191 is formed in the center of the long groove portion 192. The long groove 191 penetrates the long groove portion 192 in the up-down direction (the thickness direction). The long groove 191 has an arc shape that extends in the left-right direction. As will be explained in more detail below, a pin 135 is inserted into and engages with the long groove 191. The pin 135 (refer to FIG. 4) is provided in the support portion 133 of the needle bar base 130. The (inner side) dimension of the front-rear direction of the long groove 191 (the direction orthogonal to the extending direction of the long groove 191) is generally the same as the outer diameter of the pin 135. A central line, in the front-rear direction, of the long groove 191 intersects with a central line R of a receiving hole 193, which will be described below.

The receiving hole 193 is formed in the guide member 190. The receiving hole 193 is positioned, in the upper surface of the guide member 190, in the vicinity of the left end portion of the long groove 191. The receiving hole 193 is formed in a circular shape. The central line of the receiving hole 193 is denoted by R. The inner diameter of the receiving hole 193 is generally the same as the outer diameter of the boss portion 123 provided on the support portion 122 of the base holder 120. The depth (length) of the receiving hole 193 is slightly larger than the height of the boss portion 123.

As shown in FIG. 4, when the guide member 190 is fixed to the base holder 120, the receiving hole 193 fits with the boss portion 123. At that time, the central line R (refer to FIG. 7) of the receiving hole 193 is aligned with the central line Q (refer to FIG. 5) of the boss portion 123.

When the fixing screw 199 is slightly loosened, the fitted state between the receiving hole 193 and the boss portion 123 may be maintained. There may be a slight gap (allowance) between the fixing screw 199 and the engaging hole 194. Thus, the guide member 190 may be moved by an amount of the gap. Specifically, in a state in which the fixing screw 199 is slightly loosened, the guide member 190 may be rotated (pivoted) relative to the base holder 120 with the central lines R and Q as the center of rotation. The protruding portion 195 of the guide member 190 may protrude (refer to FIG. 3) further to the lateral side (to the left side) than the support portion 122 of the base holder 120. When adjusting the needle gap, which is the clearance between the sewing needle 101 and the hook point 9 of the horizontal shuttle 8 (refer to FIGS. 9 and 10), the user may slightly loosen the fixing screw 199. Then, by grasping and operating the protruding portion 195 with the user's fingers, the user can easily rotate the guide member 190.

The pin 135, which is provided on the support portion 133 of the needle bar base 130, engages with the long groove 191 of the guide member 190 that is fixed to the base holder 120. The pin 135 may be moved in the left-right direction along the long groove 191 while the pin 135 may not be moved in the front-rear direction. Thus, the needle bar base 130 may be guided in a direction in which the needle bar base 130 may be swung along the long groove 191 with which the pin 135 engages. Further, a range over which the needle bar base 130 may be swung is regulated by the long groove 191. A needle bar swinging mechanism is a known mechanism and is therefore not illustrated in the drawings and a detailed explanation is omitted here. As shown in FIG. 2, a connecting rod 53, which extends in the left-right direction, is coupled to the front surface of the needle bar base 130. The needle bar swinging mechanism is provided inside the pillar 3. The needle bar swinging mechanism may move the connecting rod 53 in the left-right direction, so that the needle bar base 130 may be swung in the left-right direction.

As shown in FIG. 3, a needle bar holder 163 of the needle bar drive mechanism 16 is provided on a middle portion of the needle bar 110, in a position between the support portion 133 and the bent portion 136. The needle bar holder 163 holds the needle bar 110. The needle bar holder 163 is coupled to the leading end of a crank rod 161. The crank rod 161 is connected to a needle bar crank 160. The needle bar crank 160 is coupled, via a connecting pin 162, to the thread take-up crank 52 (refer to FIG. 2). When the drive shaft 51 (refer to FIG. 2) is rotated, the thread take-up crank 52 is rotated. The needle bar crank 160 may be rotated in accordance with the rotation of the thread take-up crank 52, and thus the crank rod 161 may be driven. The needle bar crank 160, the crank rod 161, and the needle bar holder 163 may work in cooperation with each other, and may convert the rotational movement of the drive shaft 51 into a reciprocating motion in the up-down direction. The needle bar 110 may be moved up and down in this manner.

In the sewing machine 1 of the present embodiment, a stitch may be formed on the work cloth by the needle bar 110 and the horizontal shuttle 8 working in cooperation with each other. At that time, the sewing needle 101 is attached to the needle bar 110. An upper thread loop that is formed in the eye of the sewing needle 101 must be reliably picked up by the hook point 9 of the horizontal shuttle 8. In a case where the upper thread loop cannot be picked up by the hook point 9, a skipped stitch may occur in which the stitch is not formed. In this case, the sewing quality may deteriorate. In order to eliminate the skipped stitch, it is necessary to properly adjust the needle gap, which is the clearance between the sewing needle 101 and the hook point 9. In the sewing machine 1 of the present embodiment, the user may adjust the needle gap by adjusting (rotating) the adjustment dial 140. The needle bar 110 may be swung in the left-right direction. Thus, it is necessary to adjust the needle gap both when the sewing needle 101 is in the left needle drop position (the left reference line position) and when the sewing needle 101 is in the right needle drop position (the right reference line position).

Figure 9:
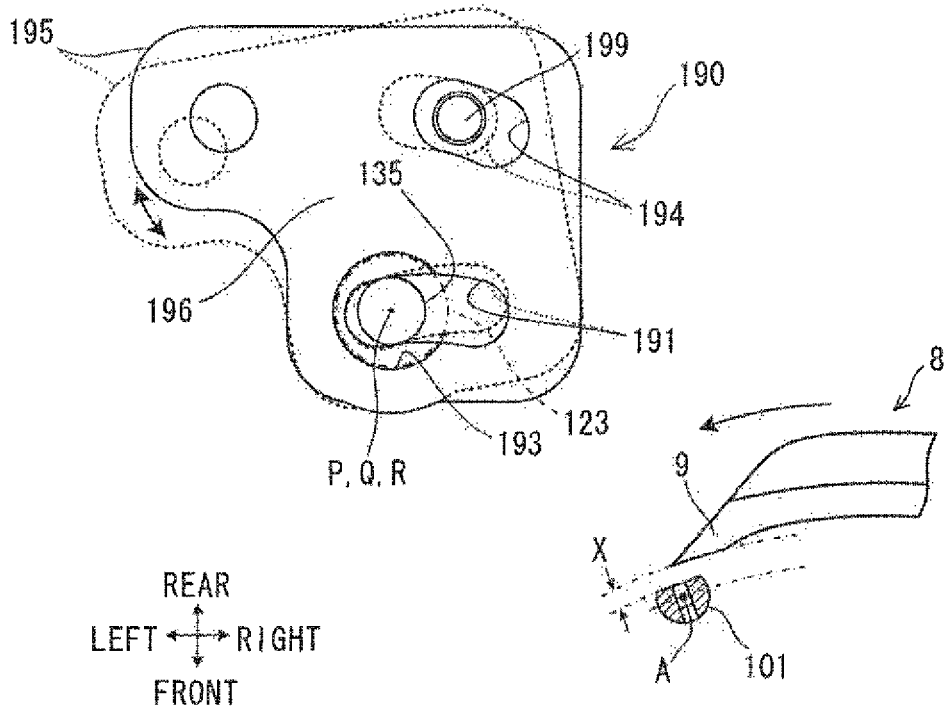
FIG. 9 is a diagram showing a state, as seen from above, of a relationship between the guide member and a left needle gap when the needle bar is positioned in a left reference line position.
Figure 10:
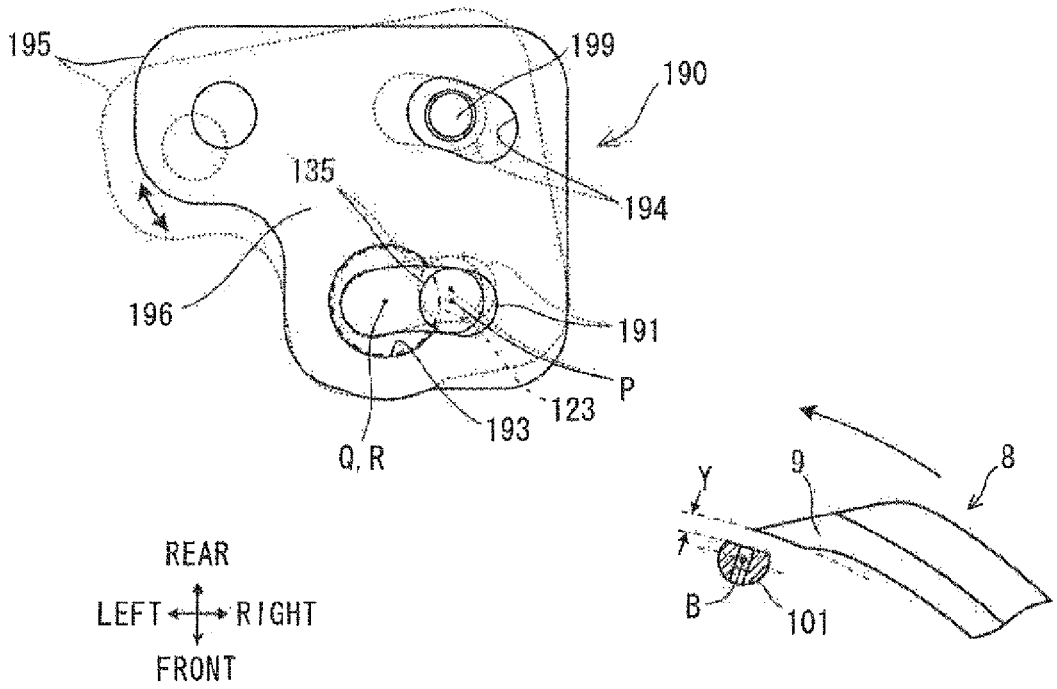
FIG. 10 is a diagram showing a state, as seen from above, of a relationship between the guide member and a right needle gap when the needle bar is positioned in a right reference line position.

In the present embodiment, it is assumed that the right needle gap is adjusted in the right reference line position after adjusting the left needle gap in the left reference line position. Hereinafter, an operation when adjusting a left needle gap X and a right needle gap Y will be explained with reference to FIGS. 9 and 10. FIG. 9 and FIG. 10 are diagrams schematically showing relationships between a position of the guide member 190, a position of the sewing needle 101 (the needle bar 110), and a position of the hook point 9 of the horizontal shuttle 8, when seen from above the sewing machine 1. In FIGS. 9 and 10, a position of the guide member 190 is shown by dotted lines when the guide member 190 is rotated within a rotatable range. The guide member 190 may be rotated within the range of the allowance between the fixing screw 199 and the engaging hole 194.

As shown in FIG. 9, the needle bar base 130 may be swung such that a central axial line position of the sewing needle 101 (the needle bar 110) may be positioned on a left reference line position A. At that time, the pin 135 is positioned close to the left end of the long groove 191 of the guide member 190. The central line P of the pin 135 may be aligned with the central line Q of the boss portion 123 and with the central line R of the receiving hole 193 that engages with the boss portion 123. The guide member 190 may be rotated in relation to the base holder 120 with the central lines R and Q as the center of rotation. Thus, even when the guide member 190 is rotated within the rotatable range, the position of the central line P of the pin 135 does not change. Thus, the position of the needle bar base 130 that is provided with the pin 135 and the position of the sewing needle 101 that is attached to the needle bar 110 do not change, irrespective of the rotation of the guide member 190. Specifically, in the left reference line position A, even if the guide member 190 is rotated, the position of the sewing needle 101 does not change. As a result, the left needle gap X does not change.

The adjustment of the left needle gap X may be performed by rotating the adjustment dial 140 provided on the needle bar support mechanism 100. When the adjustment dial 140 is rotated, the needle bar base 130 is moved in the front-rear direction. As described above, the pin 135 of the needle bar base 130 is engaged with the long groove 191 of the guide member 190 such that the pin 135 may be moved in the left-right direction while the pin 135 may not be moved in the front-rear direction. In this way, even when the needle bar base 130 is moved in the front-rear direction, the position of the pin 135 in the front-rear direction does not change. As a result, the inclination of the needle bar base 130 may change slightly, generally centering on the position at which the pin 135 and the long groove 191 are engaged with each other. More specifically, the adjustment dial 140 may be moved to the front, in a side view of the needle bar support mechanism 100. In this case, the upper portion of the needle bar base 130 may incline slightly to the front, generally centering on the position at which the pin 135 and the long groove 191 are engaged with each other. In contrast, the adjustment dial 140 may be moved to the rear. In this case, the upper portion of the needle bar base 130 may incline slightly to the rear, generally centering on the position at which the pin 135 and the long groove 191 are engaged with each other. By changing the inclination of the needle bar base 130 in this manner, the sewing needle 101 attached to the lower end portion of the needle bar 110 (which is supported by the needle bar base 130) may be moved. When the adjustment dial 140 is moved toward the front, the sewing needle 101 attached to the needle bar 110 is moved in a direction (to the rear) in which the sewing needle 101 comes closer to the hook point 9. In contrast, when the adjustment dial 140 is moved toward the rear, the sewing needle 101 is moved in a direction (to the front) in which the sewing needle 101 is separated from the hook point 9.

In actuality, the user may perform the adjustment in a state in which the needle plate 11 is removed. The user may look at the horizontal shuttle 8 from the side of the sewing machine 1, and thus visually checks the clearance between the sewing needle 101 and the hook point 9 in the left reference line position A. The user may grasp the adjustment dial 140 with the user's fingers and may rotate the adjustment dial 140. The adjustment dial 140 can easily be operated from the front face of the sewing machine 1. As described above, when the adjustment dial 140 is rotated in the clockwise direction, the adjustment dial 140 and the needle bar base 130 are moved to the rear. Thus, the sewing needle 101 may be moved to the front and may separate from the hook point 9. When the adjustment dial 140 is rotated in the anti-clockwise direction, the adjustment dial 140 and the needle bar base 130 are moved to the front. Thus, the sewing needle 101 may be moved to the rear and may approach the hook point 9. The left needle gap X between the sewing needle 101 and the hook point 9 may be adjusted by the user rotating the adjustment dial 140 with the user's fingers in this manner.

When the adjustment of the left needle gap X is finished, next, the right needle gap Y may be adjusted. As shown in FIG. 10, the needle bar base 130 may be swung such that the central axial line position of the sewing needle 101 (the needle bar 110) is positioned on the right reference line position B. At this time, the pin 135 may be positioned close to the right end of the long groove 191 of the guide member 190. The central line P of the pin 135 may be displaced from the central line Q of the boss portion 123 and the central line R of the receiving hole 193.

The user may slightly loosen the fixing screw 199 and may grasp the protruding portion 195 of the guide member 190 with the user's fingers to rotate (swing) the guide member 190. The guide member 190 may be rotated with the central lines Q and R as the center of rotation. By rotating the guide member 190, the position of the long groove 191 may be changed. The position of the pin 135 may change generally in the front-rear direction in accordance with the change in the position of the long groove 191. The lower end of the needle bar base 130 may be moved to the front and the rear in accordance with the change in the position of the pin 135. By the lower end of the needle bar base 130 moving to the front and the rear, the sewing needle 101 attached to the needle bar 110 may approach or separate from the hook point 9. The user may look at the horizontal shuttle 8 from the side of the sewing machine 1. While visually checking the clearance between the sewing needle 101 and the hook point 9 in the right reference line position B, the user may rotate the guide member 190 and may adjust the right needle gap Y.

By rotating the guide member 190 in this manner, it is possible to perform the adjustment of the right needle gap Y. As described above, even though the guide member 190 is rotated, the left needle gap X does not change. Thus, even while adjusting the right needle gap Y, it is possible to maintain the clearance for the left needle gap X. Then, when the adjustment of the right needle gap Y is finished, the user may tighten the fixing screw 199 and may fix the guide member 190 to the base holder 120. In this manner, the adjustment of the left needle gap X and the right needle gap Y may be completed.

As explained above, in the sewing machine 1 of the present embodiment, the pin 135 of the needle bar base 130 and the long groove 191 of the guide member 190 engage with each other. The guide member 190 may be rotated with respect to the base holder 120 with the central lines Q and R of the boss portion 123 and the receiving hole 193 as the center of rotation. When the needle bar 110 is positioned in the left reference line position A, the central line P of the pin 135, the central line Q of the boss portion 123 and the central line R of the receiving hole 193 are aligned and are on the same straight line. Thus, even when the guide member 190 is rotated, the position of the central line P does not change. In other words, even when the guide member 190 is rotated, the left needle gap X does not change. On the other hand, in a case where the needle bar 110 is positioned in the right reference line position B, when the guide member 190 is rotated, the central line P of the pin 135 is moved to the front and to the rear. In other words, when the guide member 190 is rotated, the right needle gap Y changes. Thus, after the left needle gap X has been adjusted in the left reference line position A, even when the right needle gap Y is adjusted in the right reference line position B, the left needle gap X does not change. As a result, it is possible to easily perform the adjustment of the left and the right needle gaps.

Due to the simple configuration in which the pin 135 of the needle bar base 130 is inserted into the long groove 191 of the guide member 190, the guide member 190 and the needle bar base 130 engage with each other. Thus, it is possible to lower the cost of the sewing machine 1.

Due to the simple configuration in which the receiving hole 193 of the guide member 190 is fitted with the boss portion 123 of the base holder 120, the base holder 120 and the guide member 190 engage with each other. Thus, it is possible to lower costs.

The protruding portion 195 protrudes from the base holder 120. The user may therefore grasp the protruding portion 195 with the user's fingers and may easily rotate the guide member 190. Thus, it is possible to easily adjust the position of the needle bar 110.

The present disclosure is not limited to the above-described embodiment and various modifications may be made. The guide member 190 is formed of the synthetic resin material. However, the guide member 190 may be formed of a metal material. The long groove 191 penetrates in the thickness direction of the guide member 190. However, as far as the length of the long groove 191 is sufficient to engage the pin 135, the long groove 191 need not necessarily penetrate the guide member 190.

In the present embodiment, after the left needle gap X has been adjusted in the left reference line position A, the right needle gap Y may be adjusted in the right reference line position B. However, the sewing machine may be configured such that the left needle gap X can be adjusted in the left reference line position A after the right needle gap Y has been adjusted in the right reference line position B. In this case also, it is possible to easily perform the adjustment of the left and the right needle gaps.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a needle bar whose lower end portion a sewing needle is attachable to;

a needle bar base that is configured to support the needle bar to allow the needle bar to be moved in an up-down direction, wherein a first engagement portion is provided to a lower end portion of the needle bar base;

a base frame that is configured to swingably support an upper end portion of the needle bar base, wherein a second engagement portion is provided to a lower end portion the base frame;

a guide member that includes a third engagement portion and a fourth engagement portion, wherein the third engagement portion is configured to engage with the first engagement portion and guide movement of the first engagement portion in a predetermined direction, and the fourth engagement portion is configured to engage with the second engagement portion; and a fixing member that is configured to fix the guide member to the base frame, wherein the first engagement portion, the second engagement portion, and the fourth engagement portion are disposed in positions where a first reference line of the first engagement portion, a second reference line of the second engagement portion, and a third reference line of the fourth engagement portion are in a same straight line when the needle bar base is in a reference position, and the guide member is configured to be swingable about the same straight line in a state in which fixing of the fixing member with respect to the base frame is loosened when the needle bar base is in a reference position.

2. The sewing machine according to claim 1, wherein the first engagement portion is a first protruding portion that is a cylindrical portion protruding in parallel to the needle bar, and the third engagement portion is a long groove into which the first protruding portion is inserted and that is configured to guide the first protruding portion to allow the first protruding portion to be moved in the predetermined direction.

3. The sewing machine according to claim 1, wherein the second engagement portion is a second protruding portion that is a cylindrical protruding portion, and the fourth engagement portion is a hole into which the second protruding portion is fitted.

4. The sewing machine according to claim 2, wherein the second engagement portion is a second protruding portion that is a cylindrical protruding portion, and the fourth engagement portion is a hole into which the second protruding portion is fitted.

5. The sewing machine according to claim 1, wherein the reference position is one of a left reference line position and a right reference line position of the needle bar.

6. The sewing machine according to claim 1, wherein the guide member further includes a protruding portion that protrudes laterally from the base frame.

* * * * *